US007221328B2

(12) United States Patent
Kuroda et al.

(10) Patent No.: US 7,221,328 B2
(45) Date of Patent: May 22, 2007

(54) RADIOWAVE LENS ANTENNA DEVICE

(75) Inventors: Masatoshi Kuroda, Osaka (JP); Masao Yokota, Osaka (JP); Yasuhiro Kamise, Tokyo (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/551,463

(22) PCT Filed: Apr. 1, 2004

(86) PCT No.: PCT/JP2004/004761

§ 371 (c)(1),
(2), (4) Date: Sep. 30, 2005

(87) PCT Pub. No.: WO2004/091048

PCT Pub. Date: Oct. 21, 2004

(65) Prior Publication Data

US 2006/0262031 A1 Nov. 23, 2006

(30) Foreign Application Priority Data

Apr. 2, 2003 (JP) ..... 2003-099386

(51) Int. Cl.
*H01Q 19/06* (2006.01)

(52) U.S. Cl. ..... 343/911 L; 343/753; 343/754

(58) Field of Classification Search ..... 343/753, 343/754, 766, 909, 911 L, 911 R
See application file for complete search history.

(56) References Cited

U.S. PATENT DOCUMENTS 3,848,255 A * 11/1974 Migdal ..... 343/761
3,972,043 A * 7/1976 Locus ..... 342/11

(Continued)

FOREIGN PATENT DOCUMENTS

DE 4011 155 A1 1/1991

(Continued)

OTHER PUBLICATIONS

Supplementary European Search Report issued in corresponding European Patent Application No. EP 04 72 5152, dated Oct. 18, 2006.

(Continued)

*Primary Examiner*—Tho Phan
(74) *Attorney, Agent, or Firm*—McDermott Will & Emery LLP

(57) ABSTRACT

Lens antenna equipment including a hemispherical Luneberg lens made of dielectric, a reflector which has a size larger than the lens diameter and which is to be provided on a face equivalent to a cross-section made by halving a globular shape of the lens, a primary feed to be arranged at a focus part of the lens, and an arm for holding the primary feed, all of which are unitarily assembled together, wherein the holder of the arm can be turned about an axis that is a perpendicular line passing the center of the lens when the reflector is attached to its installation position in a substantially perpendicular manner with respect to the ground surface, and wherein the primary feed can be moved along the surface of the lens, on a plane that is perpendicular to the axis passing the center of the lens, and on a semicircle centering the axis.

9 Claims, 8 Drawing Sheets

U.S. PATENT DOCUMENTS

| | | | | |
|---|---|---|---|---|
| 5,748,151 | A | 5/1998 | Kingston et al. | |
| 5,963,179 | A | 10/1999 | Chavez | |
| 6,266,029 | B1 | 7/2001 | Lee et al. | |
| 6,333,718 | B1 * | 12/2001 | Poncel et al. | 343/753 |
| 6,356,247 | B1 * | 3/2002 | Hirtzlin et al. | 343/911 L |
| 7,061,448 | B2 * | 6/2006 | Kuroda et al. | 343/911 L |

FOREIGN PATENT DOCUMENTS

| | | |
|---|---|---|
| JP | 2581718 | 7/1998 |
| JP | 2581719 | 7/1998 |
| JP | 2000-165131 | 6/2000 |
| JP | 2000-183645 | 6/2000 |
| JP | 2002-232230 | 8/2002 |
| JP | 2003-110349 | 4/2003 |
| JP | 2003-110350 | 4/2003 |
| JP | 2003-188640 | 7/2003 |
| WO | WO 98/53521 | 11/1998 |
| WO | WO 01/37374 A1 | 5/2001 |

OTHER PUBLICATIONS

International Preliminary Examination Report issued in corresponding International Application No. PCT/JP2004/004761, dated Mar. 2, 2006.

* cited by examiner

RADIOWAVE LENS ANTENNA DEVICE

RELATED APPLICATION

This application is the U.S. National Phase under 35 U.S.C. 0 371 of International Application No. PCT/JP2004/004761, filed Apr. 1, 2004, which in turn claims the benefit of Japanese Application No. 2003-099386, filed Apr. 2, 2003, the disclosures of which Applications are incorporated by reference herein in their entirety.

TECHNICAL FIELD

The present invention relates to lens antenna equipment having a Luneberg lens, which is used for receiving electromagnetic waves for broadcast and communication from geostationary satellites and fixed antennas on the ground or which is used for transmitting electromagnetic waves to such satellites and antennas.

BACKGROUND ART

Generally, parabolic antennas have been used for communication with geostationary satellites. Basically, however, a parabolic antenna is capable of corresponding to electromagnetic waves from only one direction. Therefore, the setting of the parabolic antenna is very difficult because three axes of a vertical direction (elevation angle), a transverse direction (azimuth angle), and an inward direction of antenna face must be adjusted for its installation. In addition, the parabolic antenna is inferior with respect to electrical and mechanical durability against a strong wind since a mast must support against the wind loading during a strong wind that blows against the dish face, and thereby it may occasionally suffer from electromagnetic interference because of bending of the mast. Also, if a firm mast is to be installed, it is susceptible to problems in terms of cost and view and to installation regulations in Europe and America as well as in Japan.

In order to solve these problems, the wall type lens antenna equipment disclosed in Japanese Patent Application Publication No. 2003-110350 and Japanese Patent Application Publication No. 2003-110352 has a reflector which has a diameter larger than the lens diameter of a hemispherical Luneberg lens made of dielectric and which is provided on the cross-section made by halving a globular shape of the hemispherical Luneberg lens, wherein the reflector is to be attached to a wall or the like substantially perpendicularly.

The above-mentioned lens antenna equipment has a mechanism in which the adjustment of positioning a primary feed at the time of installation is simplified. However, the mechanism was yet to be further improved since its performance for positioning adjustment was unsatisfactory in the case of communication with a geostationary satellite, particularly in the case of a plurality of geostationary satellites.

That is, in the case of the antenna equipment which is installed combining a hemispherical Luneberg lens and a reflector in a vertical arrangement, it is necessary to obtain information on the directions of a wall, a verandah, a fence, etc. where it is to be installed. However, it is not easy to judge them on the spot. If such a wall or the like where the antenna equipment is to be installed is located straightly facing equipment with which communication is to be established, it is convenient, but otherwise it is necessary to adjust the positioning of the primary feed, depending on the differences in the direction with respect to the equipment to be communicated with.

The antenna equipment disclosed in the above-mentioned patent applications is structured such that the position of a primary feed is determined at the focus of the lens by separately adjusting the longitude, latitude, and direction thereof, respectively. Thus, it takes time to achieve such adjustment. Particularly, when it is necessary to make the adjustment corresponding to a plurality of geostationary satellites, it is difficult to accomplish the adjustment of the positioning because the respective positions of focus of the geostationary satellites must be searched for at the site since the direction of the wall or the like is obscure.

DISCLOSURE OF THE INVENTION

In order to solve the above-mentioned problems, this invention provides lens antenna equipment of the following embodiments:

1) Lens antenna equipment comprising a hemispherical Luneberg lens made of dielectric, a reflector which has a size larger than the lens diameter and which is to be provided on a face equivalent to a cross-section made by halving a globular shape of the lens, a primary feed to be arranged at a focus part of the lens, and an arm for holding the primary feed, all of which are unitarily assembled together, wherein the holder of the arm can be turned about an axis that is a perpendicular line passing the center of the lens when the reflector is attached to its installation position in a substantially perpendicular manner with respect to the ground surface, and wherein the primary feed can be moved along the surface of the lens, on a plane that is perpendicular to the axis passing the center of the lens, and on a semicircle centering the axis.

1-1) Lens antenna equipment in which the reflector is installed at its installation position with an angle of θ degree inclined from the perpendicular condition with respect to the ground surface and in which the holder of the arm can be turned about an axis that is a line passing the center of the lens and inclined 2θ degree toward the inclining direction of the reflector when such installation of the reflector is done, wherein the primary feed can be moved along the surface of the lens, on a plane that is perpendicular to the axis passing the center of the lens, and on a semicircle centering the axis.

1-2) Lens antenna equipment in which a plurality of arms are provided with different levels of height in terms of the position of the rotational supporting point so that each primary feed is fixed at a position determined by computing the installation position of the respective primary feed in the longitudinal direction of the arms on the basis of information on the installation position of the antenna equipment and information on the position of counterpart equipment to be communicated with, wherein the respective primary feeds can be moved, by means of turn of the arms, along the surface of the lens, on a plane that is perpendicular to the axis passing the center of the lens, and on a semicircle centering the axis.

In this embodiment of the invention, the arm can be turned about an axis that is a perpendicular line passing the center of the lens, and while the primary feed held by the arm maintains its posture to face the center of the lens, such turn of the arm causes the primary feed to move on a semicircle centering the axis and on a plane that is perpendicular to the axis. Therefore, the adjustment of movement is needed with respect to only one axial direction, and accordingly the adjustment required during installation is easy as compared with parabolic antennas that need the combination of three axes and conventional lens antennas that require the positional adjustment of the primary feed by measuring the direction of wall every time and choosing the data suitable for the direction because the direction of the installation wall is obscure. Particularly, in the embodiment of the present invention, the positional adjustment is possible by simply adjusting the primary feed without making an adjustment of such a large parabolic antenna and a lens, etc.

2) Lens antenna equipment comprising a hemispherical Luneberg lens made of dielectric, a reflector having a size larger than the lens diameter and to be provided on a face equivalent to the cross-section made by halving a globular shape of the lens, a primary feed to be arranged at the focus part of the lens, a holding member for holding the primary feed, and a reflector support mast, all of which are unitarily assembled together, wherein the mast is to be fixed to a fixing structure so that the reflector is provided in a manner substantially perpendicular to the ground surface such that the reflector can be turned about the mast as a fulcrum, whereby the azimuth angle of the antenna can be adjusted.

In the lens antenna equipment according to this embodiment, its reflector is turned about the mast as a fulcrum until the turn is stopped at a position where a receiver exhibits the maximum level of reception, and the reflector is fixed with a suitable member for stopping its turn. Therefore, in this equipment also, the primary feed can be positioned at a most suitable point by performing adjustment only in one axial direction.

3) Lens antenna equipment comprising a hemispherical Luneberg lens made of dielectric, a reflector having a size larger than the lens diameter and to be provided on a face equivalent to the cross-section made by halving a globular shape of the lens, a primary feed to be arranged at a focus part of the lens, and an arched arm for holding the primary feed, the arched arm being provided such that the arched arm can pass along, and with a constant distance apart from, the spherical surface of the lens, all of which are unitarily assembled together, wherein both ends of the arm can be moved along a circular orbit which is concentric with the peripheral circumference of the lens, and wherein the primary feed is installed on the arm such that it can be moved in a longitudinal direction of the arm.

In the lens antenna equipment according to the composition of 3), the position of the primary feed is displaced by sliding on the arm in a longitudinal direction of the arm so that the primary feed is positioned at a most suitable point by combination of such sliding operation and an operation of moving both ends of the arm in the same direction along a circular orbit. The adjustment can be easily done if the primary feed provided on the arm is moved, by turning the arm, toward an aimed position along a line which is marked on the cover of the lens beforehand and which is parallel to a plane that is perpendicular to the axis of the lens.

4) Lens antenna equipment comprising a hemispherical Luneberg lens made of dielectric, a reflector which has a size larger than the lens diameter and which is to be provided on a face equivalent to the cross-section made by halving a globular shape of the lens, primary feeds to be arranged at focus parts of the lens, and first and second arms for holding the primary feeds, all of which are unitarily assembled together, wherein the holder of the first arm can be turned about an axis that is a perpendicular line passing the center of the lens when the reflector is attached to its installation position in a substantially perpendicular manner with respect to the ground surface, the first arm enabling a primary feed to move along the surface of the lens, on a plane that is perpendicular to the axis passing the center of the lens, and on a semicircle centering the axis, and wherein the second arm is an arched arm which can be moved along the spherical surface of the lens with a constant distance apart from the surface of the lens, both ends of the second arm being structured so as to move along a circular orbit which is concentric with the peripheral circumference of the lens, and the second arm, which can be connected with the primary feed attached to the first arm, holds the other primary feeds.

4-1) An n-th primary feed out of n number of (n is a positive integer) primary feeds to be arranged in the focus part of the lens is held by a first arm which can be moved along the surface of the lens, on a plane perpendicular to an axis passing the center of the lens, and on a semicircle centering the axis, and the second arm is structured so as to turn in a manner centering the n-th primary feed, wherein primary feeds other than the n-th primary feed are installed on the second arm.

The lens antenna equipment according to the composition of 4), which is a lens antenna system having a structure according to the above-described compositions (1) and (3) and using the arms of the compositions (1) and (3), exhibits the combined effects of the compositions (1) and (3). The lens antenna equipment according to the composition (4) is particularly effective for adjusting the positions of primary feeds to the respective focus position of a plurality of satellites, and makes it possible to easily perform positional adjustment of a plurality of primary feeds at once.

5) Lens antenna equipment comprising a hemispherical Luneberg lens made of dielectric, a first reflector, at least upper half thickness part of which has a disk form and which is to be provided on a face equivalent to the cross-section made by halving a globular shape of the lens, a primary feed to be arranged at the focus part of the lens, and an arm for holding the primary feed, all of which are unitarily assembled together, wherein the first reflector can be turned, within the same plane, about an axis at the center of the lens.

5-1) Lens antenna equipment comprising a hemispherical Luneberg lens made of dielectric, a first reflector having a size larger than the lens diameter and to be provided on a face equivalent to the cross-section made by halving a globular shape of the lens, a primary feed to be arranged at the focus part of the lens, and an arm for holding the primary feed, all of which are unitarily assembled together, wherein the first reflector out of a plurality of reflectors holds the arm and the other reflectors attached to the first reflector such that the first reflector and the other reflectors are combined together in a mutually turnable manner.

5-2) Lens antenna equipment in which the first reflector and the other reflectors are attachable and detachable, and the other reflectors can be fixed at their respective positions determined as a result of their rotating movement relative to the first reflector.

In the lens antenna equipment according to the compositions of (5), instead of adjusting the position of the primary feed, the position of the reflecting surface is adjusted by moving a reflector, in the case where one satellite or a plurality of satellites existing in the vicinity. If a reflector is large enough to absorb differences in the direction with counterpart equipment to be communicated with, the troublesome adjustment is unnecessary, but in such case the equipment inevitably becomes large-sized. The size of a reflector in the equipment according to the composition of (5) can be decreased to the necessary minimum since the reflector is structured to allow its movement to an optimum region for the reflection of electromagnetic waves.

Moreover, the size of reflectors in the first, third, and fourth embodiments of the invention can also be decreased to the necessary minimum in combination with the fifth embodiment of the invention.

Also, in the case of the lens antenna equipment according to these embodiments, scenic incongruity can be minimized since it can be closely attached to a wall in a manner such that the reflector becomes assimilated to the wall and only the hemispherical lens protrudes from the wall. For example, it is possible to assimilate the whole antenna with the wall by adopting a design in which the surfaces of the lens and the reflector are provided with the same pattern as that of the installation surface or by using a transparent plastic reflector in which a reinforcement material such as a metallic mesh is buried.

Besides, electromagnetic interference due to a wind or the like will rarely be caused because the support of the antenna is accomplished directly with a wall and because a hemispherical lens is not so susceptible to wind pressure. Also, it is advantageous in terms of cost that there is no need to install a solid mast.

Hereinafter, the composition of 1) described above is called a first embodiment, the composition of 2) is called a second embodiment, the composition of 3) is called a third embodiment, the composition of 4) is called a fourth embodiment, and the composition of 5) is called a fifth embodiment. The compositions of 1-1) and 1-2) are considered as modified examples of the first embodiment. Likewise, the composition of 4-1) is a modified example of the fourth embodiment; the compositions of 5-1) and 5-2) are modified examples of the fifth embodiment. In any antenna equipment according to these embodiments, it is possible to adopt a method for assimilating the whole antenna with the wall by providing the surfaces of the lens and the reflector with a pattern which is the same as that of the installation surface, or by using a transparent plastic reflector in which a reinforcement material such as a metallic meshes is buried.

Also, the lens antenna equipment according to the composition of (4) and (4-1) can be changed to have a structure in which a reflector is tilted to the ground by θ degree from the perpendicular condition, and in this case, the first arm should be designed to turn about an axis of the line inclined 2θ degree which passes the center of the lens.

BEST MODE FOR CARRYING OUT THE INVENTION

Figure 1:
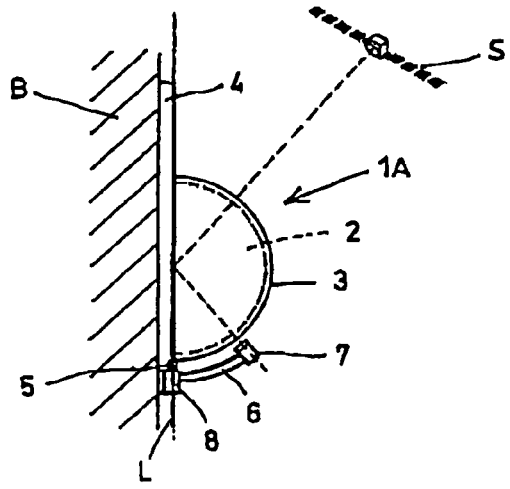
FIG. 1 is a side view showing an example of lens antenna equipment according to the first embodiment.

In the following, the present invention will be described in more detail. For description of the drawings, the same reference marks denote the same elements, and a repeated explanation will be omitted. The dimensions in the drawings do not always correspond to actual ratios of dimensions.

FIG. 1 shows an example of lens antenna equipment according to the first embodiment. The lens antenna equipment 1A comprises a hemispherical Luneberg lens 2 made of dielectric, a hemispherical cover 3 to protect the surface of the lens by covering it, a reflector 4 to be provided on a face equivalent to the cross-section made by halving a globular shape of the lens, an arm 6 supported by a fixing axis 5 assembled with the reflector 4, and a primary feed 7 held by the arm 6, all of which are unitarily assembled together.

The reflector 4 has a size larger than the diameter of the lens 2 so as to surely receive electromagnetic waves from counterpart equipment to be communicated with (in the figure, a geostationary satellite S). When the reflector 4 is attached to its installation position in a manner substantially perpendicular to the ground surface, the fixing axis 5, which is an axis about which the arm 6 turns, is located on a perpendicular line passing the center of the lens and takes a posture which is perpendicular to the ground surface.

The arm 6 has a form arched along the surface of the lens 2. The holder of the arm 6 constitutes a revolving part 8 by being installed so as to turn about the outer periphery of the fixing axis 5 and not to move in the axial direction. A primary feed 7, which is to be arranged in the focus part of the lens 2, is mounted on the arm 6 which is equipped with the revolving part 8.

The primary feed 7 can be adjusted beforehand with respect to the latitude and the elevation angle since the position of a geostationary satellite S to be communicated with is known in advance, and consequently the adjustment on the installation site may only be concerned with the longitude relative to the direction of a wall B.

When the arm 6 is turned slowly in one direction using the fixing axis 5 as a fulcrum, the primary feed 7 moves along the globular surface of the lens 2 while maintaining its posture directing to the center of the lens, and accordingly the receiver's receiving level of electromagnetic waves changes gradually. Therefore, the turn of the arm 6 is stopped at a position where the receiving level of the electromagnetic wave becomes the maximum, and the revolving part 8 is fixed on the fixing axis 5 with a screw, which is not illustrated in the figure.

The exemplary antenna equipment 1A can be designed to ease a sense of scenic incongruity by providing the surfaces of the cover 3 and the reflector 4 with a suitable pattern to assimilate them with the wall B or by making the reflector using a transparent board.

Figure 2A:
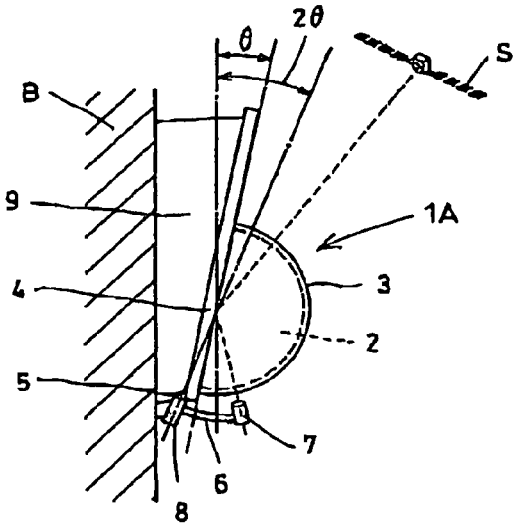
FIG. 2(*a*) is a side view showing a modified example of lens antenna equipment according to the first embodiment, and FIG. 2(*b*) is a side view showing another modified example.
Figure 2B:
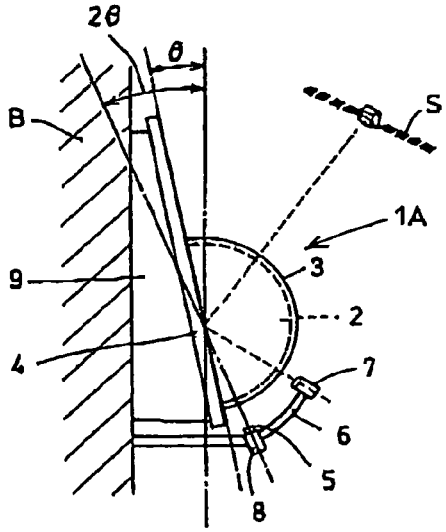

FIGS. 2(*a*) and 2(*b*) show another example of lens antenna equipment according to the first embodiment. It may be effective in terms of countermeasures against electromagnetic wave blocking, miniaturization of the reflector, and countermeasures against snow fall that the reflector 4 is attached to the installation position by tilting it to the ground at θ degree forward or backward from the perpendicular condition as shown in FIG. 2(*a*) and FIG. 2(*b*), depending on the direction of the wall B on which the antenna equipment is to be installed or the installation site, and so on. The inclination of θ degree for installation of the reflector 4 can easily be done, for example, by providing an attachment 9 between the reflector and the wall B. In such case, in order to avoid an influence of the inclination of the reflector 4, the holder of the arm 6 should be designed to be capable of turning about an axis which is a line inclined 2θ degree in the direction of the inclination of the reflector 4.

In this case, when the line perpendicular to the ground surface is 0 degree, the angle θ may be equal to or less than plus or minus 45 degrees and preferably in the range of plus or minus 15 degrees. If a forward inclination angle is provided, it is suitable for anti-snowfall measure, and if an elevation angle is provided, the reflector can be downsized in the case of reception from a satellite with a high elevation angle.

Figure 3:
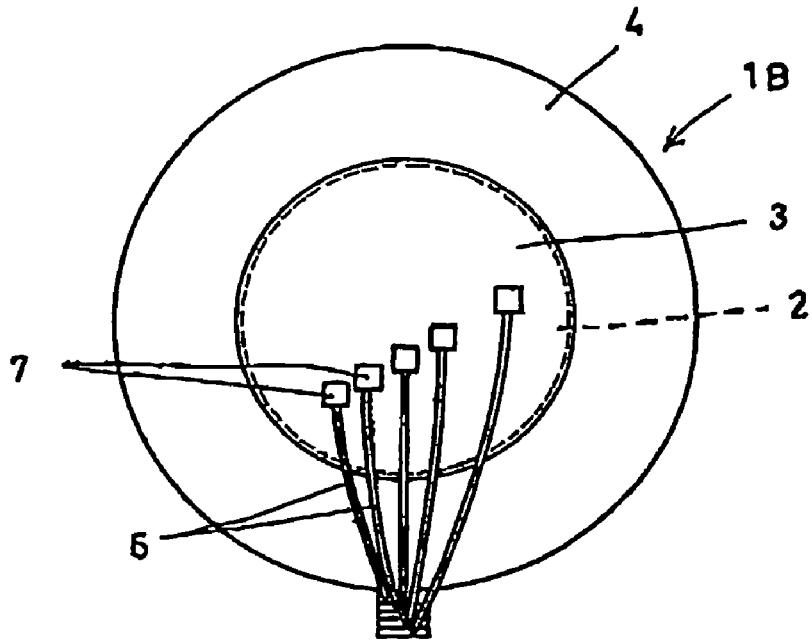
FIG. 3 is a front view showing another modified example of lens antenna equipment according to the first embodiment.

FIG. 3 shows a modified example of lens antenna equipment according to the first embodiment. The lens antenna equipment 1B has a plurality of arms 6, in which the height position of revolving parts 8 (height position of their respective rotational supporting point) is changed, and uses a wide circular reflector as a reflector 4, which has a broad compatible region to the incoming direction of electromagnetic waves. In the lens antenna equipment 1B of FIG. 3, each primary feed 7 is provided at a position determined by computing the installation position of the respective primary feed in the longitudinal direction of each arm 6 on the basis of positional information on the installation position and the counterpart equipment to be communicated with, and by turning each arm 6 so that the respective primary feed 7 is moved to the target point along the surface of the lens, on a plane that is perpendicular to the axis passing the center of the lens, and on a semicircle centering the axis.

Figure 4:
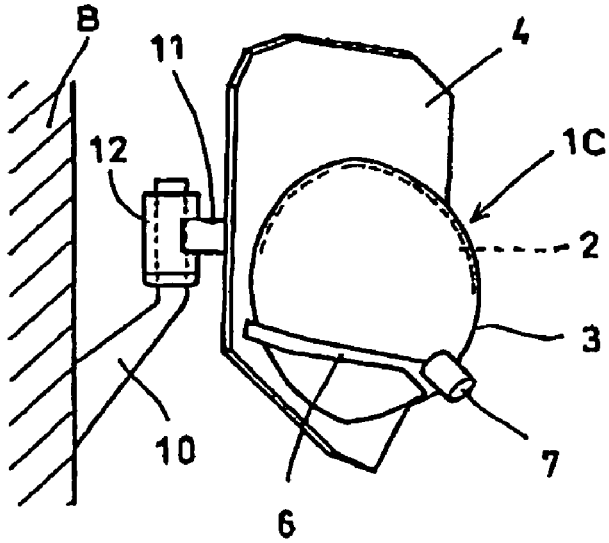
FIG. 4 is a perspective view showing an example of lens antenna equipment according to the second embodiment.

FIG. 4 shows an example of lens antenna equipment according to the second embodiment. In the lens antenna equipment 1C, a mast 10 to be fixed on wall B or the like is inserted in a sleeve 12 provided at the tip of a connection member 11 which is attached to the rear surface of a reflector 4, and the sleeve 12 is turnably engaged with the perpendicular axis part of the mast 10. An arm 6 for holding a primary feed 7 is structured such that its root portion is fixed to the reflector 4. The other composition is the same as the antenna equipment of FIG. 1. In the lens antenna equipment 1C of FIG. 4, the position of primary feed 7 is adjusted in advance to fit the geostationary satellite which is the counterpart equipment to be communicated with, and accordingly only adjustment needed at the installation site is to turn, relative to the mast 10, the whole antenna to the position where the receiving level of the electromagnetic wave becomes maximum. After the adjustment is completed, the sleeve 12 is fixed to the mast 10 with a screw or the like so that an antenna does not turn around.

Figure 5A:
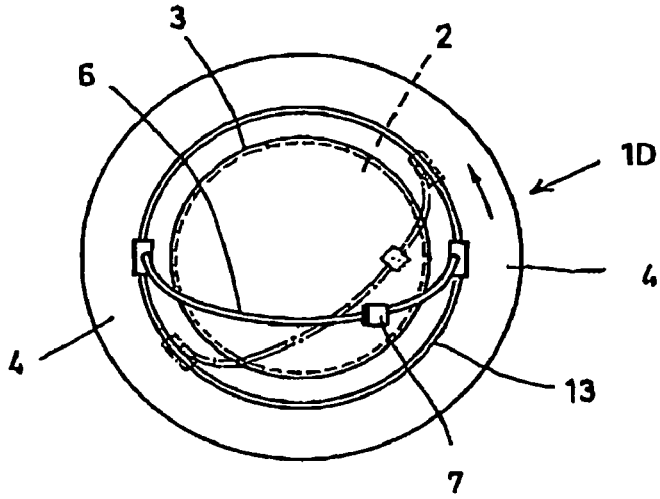
FIG. 5(*a*) is a front view showing an example of lens antenna equipment according to the third embodiment, and FIG. 5(*b*) is a side view showing an example of the lens antenna equipment according to the third embodiment.
Figure 5B:
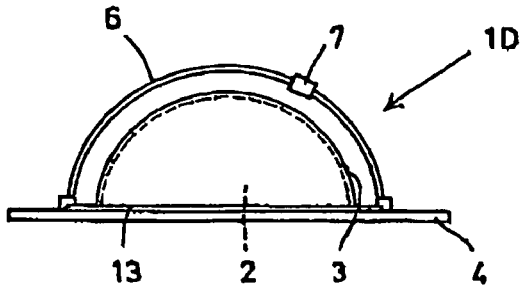

FIGS. 5(*a*) and 5(*b*) show an example of lens antenna equipment according to the third embodiment. In the lens antenna equipment 1D, a circular reflector 4 is used, and a circular orbit 13 which is concentric with a lens 2 is provided on the reflector 4. An arm 6 holding a primary feed 7 is formed into an arched shape to stride the lens 2, and both ends of the arm 6 are movably fixed to the circular orbit 13. The lens antenna equipment 1D of FIG. 5 is also structured such that the primary feed 7 can be moved by sliding it on the arm 6 in the arm's longitudinal direction. Thus, the primary feed 7 can be positioned to an optimum point by combining such two moving operations. The adjustment can easily be done if a line, which is to be afforded on the surface of the lens 2 and which is parallel to a plane perpendicular to the axis of the lens 2, is marked in advance on a cover 3 for covering the lens 2, and if the primary feed 7 on the arm 6 is moved, by turning the arm 6, to the target point (focus) along the latitude made of the line.

Figure 6:
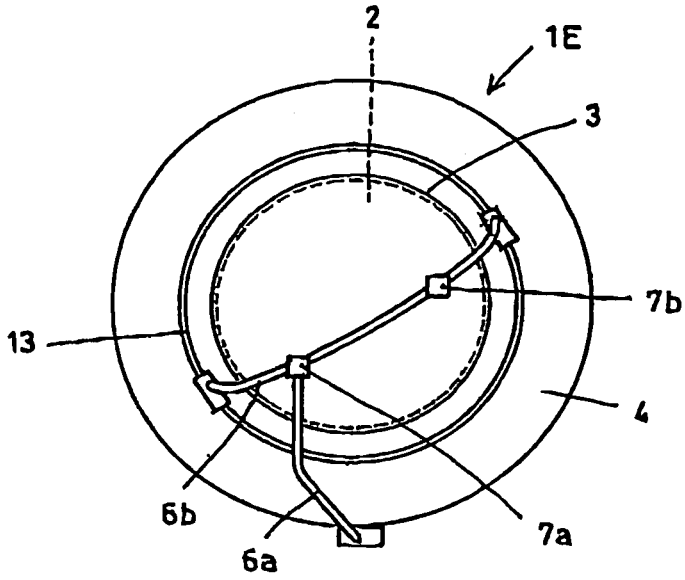
FIG. 6 is a front view showing an example of lens antenna equipment according to the fourth embodiment.
Figure 8A:
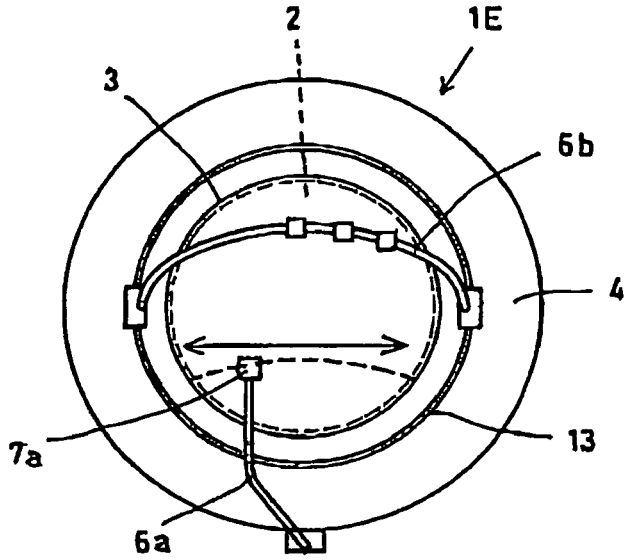
FIGS. 8(*a*), 8(*b*), and 8(*c*) illustrate procedures for setting up the lens antenna equipment shown in FIG. 6 as an example of the invention.
Figure 8B:
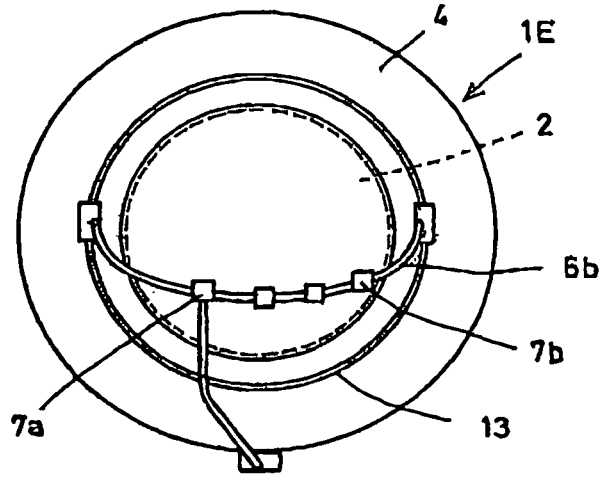
Figure 8C:
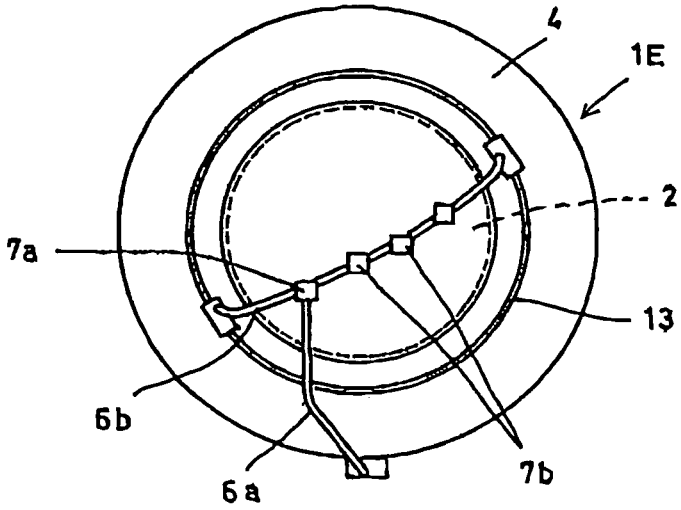

FIG. 6 shows an example of lens antenna equipment according to the fourth embodiment. The lens antenna equipment 1E has a structure in which the arm 6 of the antenna equipment of FIG. 1 is added to the antenna equipment of FIG. 5. Here, in order to distinguish two arms and primary feeds to be mounted on the arms, symbols a and b are added to the mark 6 representing arms and the mark 7 representing primary feeds, respectively. A holder part (not illustrated in the figure) for turnably engaging an arm 6*b* in relative movement of two axial directions is provided in a primary feed 7*a* which is to be mounted on an arm 6*a*. In the lens antenna equipment 1E of FIG. 6, first, the arm 6*a* is turned as shown in FIG. 8(*a*) to find a position where the reception sensitivity of the primary feed 7*a* which has been positioned and installed on the arm 6*a* becomes maximum. Next, as shown in FIG. 8(*b*), the arm 6*a* is fixed, and subsequently the arm 6*b* is moved to the place where the holder part and the position thereof agree by changing its elevation angle, and then the arm 6*b* is mounted in the holder part of the primary feed 7*a* which is installed on the arm 6*a*. Then, as shown in FIG. 8(*c*), in order to find the position where the reception sensitivity of the primary feed 7*b*, which is positioned and installed beforehand on the arm 6*b*, becomes maximum, the arm 6*b* is turned along the circular orbit 13 while the elevation angle is changed again.

The lens antenna equipment 1E of FIG. 6 can be adjusted by the turning operation of arms 6*a* and 6*b*, and setting up thereof can be completed without most difficult measurement of the wall direction. Therefore, it is suitable for use as a multi-beam antenna in which a plurality of primary feeds are mounted on an arm 6*b*. Arm 6*a* can be removed after the completion of adjustment.

Figure 7:
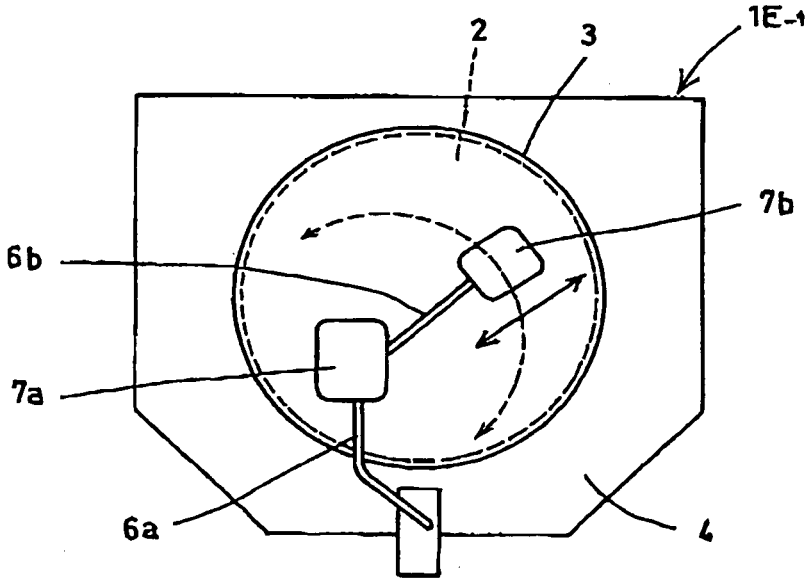
FIG. 7 is a front view showing a modified example of lens antenna equipment according to the fourth embodiment.

FIG. 7 shows a modified example of lens antenna equipment shown in FIG. 6. In the lens antenna equipment 1E-$_1$ of FIG. 7, when an arm 6*a* turns, a primary feed 7*a* which is held by the arm 6*a* moves along the lens surface and on a line which is parallel to a plane perpendicular to the axis of the lens. An arm 6*b* having an arched shape formed along the spherical surface of a lens 2 can be turned around the primary feed 7*a*, and as a result of such turn, a primary feed 7*b* held by the arm 6*b* moves in a direction indicated by a dotted line arrow. The primary feed 7*b* may be movable or fixed in the longitudinal direction (directions indicated by the arrows of solid line) of the arm 6*b*.

Thus, in the lens antenna equipment 1E-$_1$ of FIG. 7, the position of the primary feed 7*a* is adjusted first by turning the arm 6*a*. Next, the arm 6*b* is turned centering the primary feed 7*a* which has been positioned, and thereby the position where the reception sensitivity of the primary feed 7*b* becomes maximum is found, and the position is determined as the installation position of the primary feed 7*b*. The distance between the primary feeds 7*a* and 7*b* can be determined beforehand based on the satellite position and the latitude and longitude of the antenna installation point since the distance has no relationship with the direction of the antenna installation surface (wall). When it is necessary to correspond to another satellite, another primary feed may be installed on the arm 6*b* at the position determined in accordance with the pre-calculated distance from the primary feed.

In all of the antenna equipment described herein as examples, the polarization angle of the primary feeds can be adjusted respectively by turning each primary feed in the respective holder (not illustrated) which holds the primary feed.

In the antenna equipment shown in FIG. 1–FIG. 7, depending on the direction of the wall or the latitude of the installation site, it may be needed to provide a larger reflector or the blocking of electromagnetic waves by the primary feed may occasionally occur. However, as described in Japanese Patent Application Publication No. 2003-110350, by affording a vertical or horizontal angle to the reflector it is possible to decrease the size of the reflector and to minimize the influence due to the blocking by the primary feed.

Figure 9A:
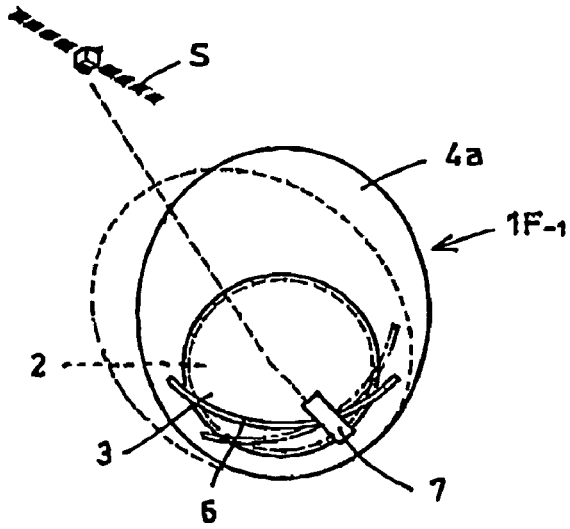
FIG. 9(*a*) is a front view showing an example of lens antenna equipment according to the fifth embodiment, and FIG. 9(*b*) is a front view showing another example of the lens antenna equipment according to the fifth embodiment, FIG. 9(*c*) showing a side view thereof.
Figure 9B:
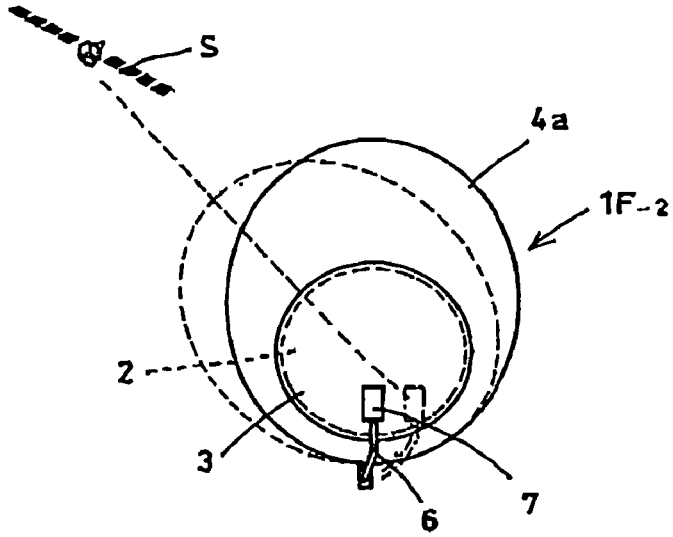
Figure 9C:
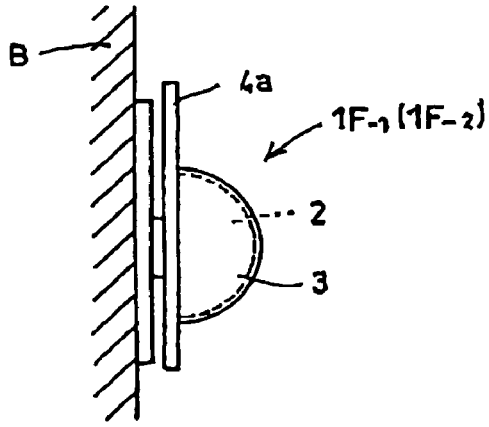

FIG. 9 is an example of the lens antenna equipment according to the fifth embodiment. The lens antenna equipment 1F-$_1$ and 1F-$_2$ comprises a hemispheric Luneberg lens 2, the surface of which is covered with a protective cover 3 of hemispheric shape, a reflector 4, which is to be provided on a face equivalent to a cross-section made by halving a globular shape of the lens 2, an arched arm 6, which is designed to stride a lens 2 and whose elevation angle can be adjusted, and a primary feed 7 to be arranged at the focus position and held by the arm 6, all of which are unitarily assembled together.

As shown in FIGS. 9(*a*) and 9(*b*), a first reflector 4*a*, which is formed in a shape that is longer in one direction (in the case of FIG. 9, an elliptical form) and on which a lens 2 is arranged, is held by a turn-stand on an installation board which is to be fixed on a wall B as shown in FIG. 9(*c*) such that the first reflector 4*a* can be turned with the lens 2, using an axis at the center of the lens 2.

Figure 10A:
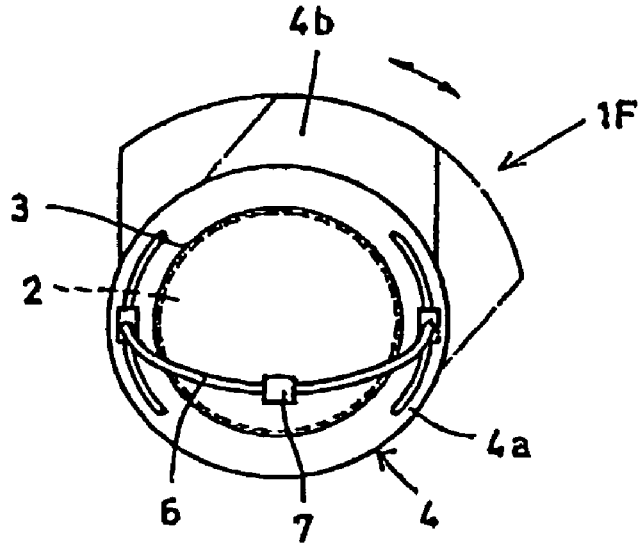
FIG. 10(*a*) is a front view showing another example of lens antenna equipment according to the fifth embodiment, and FIG. 10(*b*) is a side view thereof.
Figure 10B:
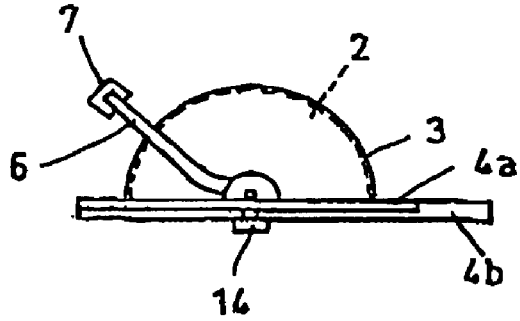

In lens antenna equipment 1F of FIG. 10, a reflector 4 comprises a first reflector 4*a* having a diameter somewhat larger than the lens diameter and a second reflector 4*b* added to the outer periphery (upper edge part) of the first reflector 4*a*, wherein the second reflector 4*b* is connected to the first reflector 4*a* in a mutually turnable manner with a pivot axis 14 at the center of a lens 2 such that the second reflector can be turned using the pivot axis 14 as a fulcrum. In the case of FIG. 10, the first reflector is circular, but at least the part thereof which touches with the second reflector 4*b* because of the relative may be circular.

In the case of structures shown in FIGS. 9 and 10, the arm 6 may be fixed to the reflector so as to turn together with the reflector, or may be supported by a wall, installation member, mast, or the like so that the positional adjustment of the primary feed 7 can be done in a manner separate from the turn of the reflector.

Figure 11A:
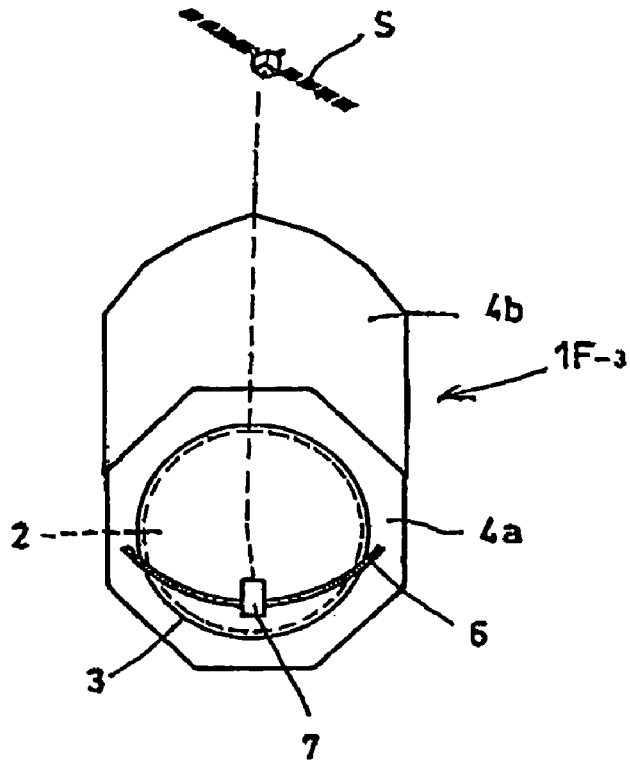
FIG. 11(*a*) is a front view showing another example of lens antenna equipment according to the fifth embodiment, and FIG. 11(*b*) is a front view showing the example in a condition after the reflector has been turned.
Figure 11B:
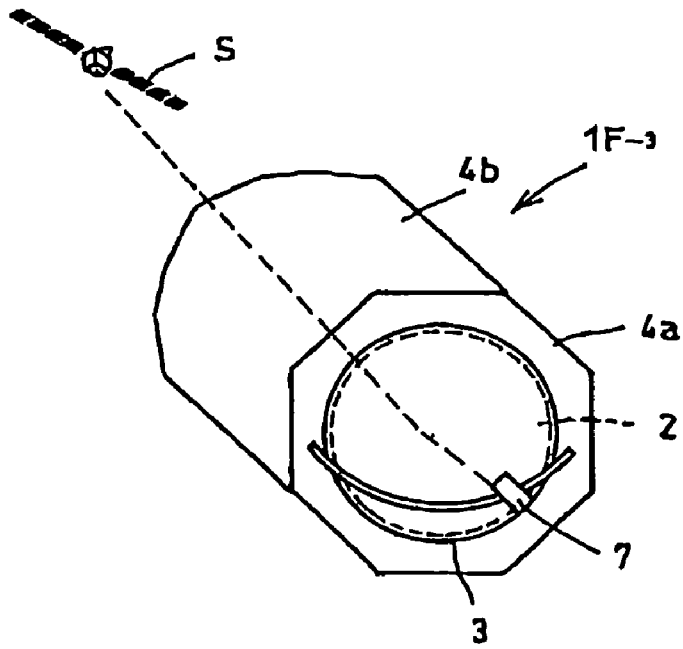

As shown in FIGS. 11(*a*) and (*b*), the first reflector 4*a* and the second reflector 4*b* may be attachable and detachable so that turning operation can be accomplished in a state where the second reflector is removed from the first reflector, and both reflectors may be combined together and fixed at a relative position where the turning operation is accomplished. Thus, the lens antenna equipment 1F, 1F-$_1$, 1F-$_2$, and 1F-$_3$, which are designed such that a reflector can be turned toward the direction of a geostationary satellite S can be downsized by adding only a necessary reflector.

INDUSTRIAL APPLICABILITY

In the lens antenna equipment of this invention, as described above, the positional adjustment of the primary feed relative to the counterpart equipment to be communicated with can be done quickly and easily only by an adjustment of one axial direction, that is, a turn of an arm or the turn of an antenna relative to a mast thereof even if the direction of the wall and the like is unknown. Particularly, even in the case of corresponding to a plurality of satellites, each primary feed can be positioned to the focus position of the lens only by one axial adjustment such as a turn of the arm, whereby time needed for adjustment can be reduced substantially, and a work load can also be reduced.

Also, in the case of lens antenna equipment in which adjustment is done by turning the arm, a reflector can be closely attached to a wall, scenic incongruity can be eased and weatherproof property can also be sufficiently enhanced. Moreover, it is advantageous in terms of cost since it does not need a solid mast.

In the case of lens antenna equipment in which the adjustment is done by turning the whole antenna relative to the mast, only one axial adjustment is needed, and accordingly the adjustment for installation is remarkably easy as compared with a conventional antenna.

Furthermore, in the case of lens antenna equipment in which a reflector is designed to be turned about an axis at the center of the lens in the same plane or that in which a plurality of reflectors are provided such that the position of a reflector on the outer periphery side can be changed, it is possible to downsize the antenna equipment by decreasing the size of the reflector to the necessary minimum.

The invention claimed is:

1. Lens antenna equipment comprising:

a hemispherical Luneberg lens made of dielectric, a reflector having a size larger than the lens diameter and provided on a face equivalent to a cross-section made by halving a globular shape of the lens, a primary feed to be arranged at a focus part of the lens, and an arm for holding the primary feed, all of which are unitarily assembled together, wherein the holder of the arm can be turned about an axis that is a perpendicular line passing the center of the lens when the reflector is attached to its installation position in a substantially perpendicular manner with respect to the ground surface, and wherein the primary feed can be moved along the surface of the lens, on a plane that is perpendicular to the axis passing the center of the lens, and on a semicircle centering the axis.

2. Lens antenna equipment comprising:

a hemispherical Luneberg lens made of dielectric, a reflector having a size larger than the lens diameter and provided on a face equivalent to a cross-section made by halving a globular shape of the lens, a primary feed to be arranged at a focus part of the lens, and an arm for holding the primary feed, all of which are unitarily assembled together, wherein the holder of the arm can be turned about an axis that is a line passing the center of the lens and inclined 2θ degree toward the inclining direction of the reflector when the reflector is installed at its installation position with an angle of θ degree inclined from the perpendicular condition with respect to the ground surface, and wherein the primary feed can be moved along the surface of the lens, on a plane that is perpendicular to the axis passing the center of the lens, and on a semicircle centering the axis.

3. Lens antenna equipment according to claim 1 or 2, wherein a plurality of arms are provided with different levels of height in terms of the position of the rotational supporting point so that each primary feed can be fixed at a position determined by computing the installation position of the respective primary feed in the longitudinal direction of the arms on the basis of information on the installation position of the antenna equipment and information on the position of counterpart equipment to be communicated with, and wherein the respective primary feeds can be moved, by means of turn of the respective arms, along the surface of the lens, on a plane that is perpendicular to the axis passing the center of the lens, and on a semicircle centering the axis.

4. Lens antenna equipment comprising:

a hemispherical Luneberg lens made of dielectric, a reflector having a size larger than the lens diameter and provided on a face equivalent to a cross-section made by halving a globular shape of the lens, a primary feed to be arranged at a focus part of the lens, a holding member for holding the primary feed, and a reflector support mast to be fixed to a fixing structure in a substantially perpendicular manner with respect to the ground surface, all of which are unitarily assembled together, wherein the reflector is mounted to the mast such that the reflector can be turned about the mast as a fulcrum, whereby the azimuth angle of the antenna can be adjusted.

5. Lens antenna equipment comprising:

a hemispherical Luneberg lens made of dielectric, a reflector having a size larger than the lens diameter and provided on a face equivalent to the cross-section made by halving a globular shape of the lens, primary feeds to be arranged at focus parts of the lens, and first and second arms for holding the primary feeds, all of which are unitarily assembled together, wherein the holder of the first arm can be turned about an axis that is a perpendicular line passing the center of the lens when the reflector is attached to its installation position in a substantially perpendicular manner with respect to the ground surface, the first arm enabling a primary feed to move along the surface of the lens, on a plane that is perpendicular to the axis passing the center of the lens, and on a semicircle centering the axis, wherein the second arm is an arched arm which can be moved along the spherical surface of the lens with a constant distance apart from the of the lens, both ends of the second arm being capable of moving along a circular orbit which is concentric with the peripheral circumference of the lens, and wherein the second arm, which can be connected with the primary feed attached to the first arm, holds the other primary feeds.

6. Lens antenna equipment comprising:

a hemispherical Luneberg lens made of dielectric, a reflector having a size larger than the lens diameter and provided on a face equivalent to the cross-section made by halving a globular shape of the lens, n number of (n is a positive integer) primary feeds to be arranged at focus parts of the lens, and first and second arms for holding the n number of primary feeds, all of which are unitarily assembled together, wherein the holder of the first arm can be turned about an axis that is a perpendicular line passing the center of the lens when the reflector is attached to its installation position in a substantially perpendicular manner with respect to the ground surface, and an n-th primary feed out of primary feeds to be arranged in the focus part of the lens is held by a first arm such that the n-th primary feed can be moved along the surface of the lens, on a plane perpendicular to an axis passing the center of the lens, and on a semicircle centering the axis, and wherein the second arm is structured so as to turn in a manner centering the n-th primary feed, and primary feeds other than the n-th primary feed are installed on the second arm.

7. Lens antenna equipment comprising:

a hemispherical Luneberg lens made of dielectric, a first reflector, at least upper half thickness part of which has a disk form and which is to be provided on a face equivalent to the cross-section made by halving a globular shape of the lens, a primary feed to be arranged at the focus part of the lens, and an arm for holding the primary feed, all of which are unitarily assembled together, wherein the first reflector can be turned, within the same plane, about an axis at the center of the lens.

8. Lens antenna equipment comprising:

a hemispherical Luneberg lens made of dielectric, a first reflector having a size larger than the lens diameter and to be provided on a face equivalent to the cross-section made by halving a globular shape of the lens, a primary feed to be arranged at the focus part of the lens, and an arm for holding the primary feed, all of which are unitarily assembled together, wherein the first reflector out of a plurality of reflectors holds the arm, and the other reflectors are attached to the first reflector such that the first reflector and the other reflectors are combined together in a mutually turnable manner.

9. Lens antenna equipment according to claim 8, wherein the first reflector and the other reflectors are attachable and detachable, and the other reflectors can be fixed at their respective positions determined as a result of their rotating movement relative to the first reflector.

* * * * *